US009345366B2

(12) United States Patent
Chang

(10) Patent No.: US 9,345,366 B2
(45) Date of Patent: May 24, 2016

(54) BATHING AID AND BATHING ASSEMBLY USING THE SAME

(71) Applicant: Che-Yuan Chang, Yuanlin Township (TW)

(72) Inventor: Che-Yuan Chang, Yuanlin Township (TW)

( * ) Notice: Subject to any disclaimer, the term of this patent is extended or adjusted under 35 U.S.C. 154(b) by 216 days.

(21) Appl. No.: 14/030,292

(22) Filed: Sep. 18, 2013

(65) Prior Publication Data

US 2014/0013532 A1 Jan. 16, 2014

Related U.S. Application Data

(63) Continuation-in-part of application No. 12/892,878, filed on Sep. 28, 2010, now abandoned, which is a continuation-in-part of application No. 12/034,188, filed on Feb. 20, 2008, now abandoned.

(30) Foreign Application Priority Data

Sep. 21, 2007 (TW) ..... 96215985 U

(51) Int. Cl.
*A47K 7/02* (2006.01)

(52) U.S. Cl.
CPC .. *A47K 7/02* (2013.01); *A47K 7/024* (2013.01)

(58) Field of Classification Search
USPC ..... 15/104.92, 160, 161, 209.1, 210.1, 15/215–217, 229.11, 244.1, 244.3; 4/606; 601/136; D28/63
See application file for complete search history.

(56) References Cited

U.S. PATENT DOCUMENTS

| | | | | |
|---|---|---|---|---|
| 1,954,940 | A | 4/1934 | Mikel | |
| 2,680,698 | A | 6/1954 | Schnee | |
| 3,909,996 | A | 10/1975 | Ettlinger, Jr. et al. | |
| 4,890,352 | A | 1/1990 | Stowers et al. | |
| 5,175,896 | A | 1/1993 | Zamir | |
| 5,490,821 | A | 2/1996 | Wu | |
| 5,704,903 | A | 1/1998 | Jahnke | |
| 5,811,165 | A * | 9/1998 | Andreen | 428/52 |
| 6,276,022 | B1 * | 8/2001 | Gallacher | 15/209.1 |
| 6,343,774 | B1 | 2/2002 | Thomas et al. | |
| 6,568,029 | B1 * | 5/2003 | Letts | 15/106 |
| 6,584,638 | B2 * | 7/2003 | Nigh et al. | 15/209.1 |
| 7,331,080 | B2 * | 2/2008 | Chen | 15/110 |
| 7,500,282 | B1 | 3/2009 | Park | |
| 2002/0151829 | A1 | 10/2002 | Tien | |
| 2002/0166187 | A1 | 11/2002 | Rowe | |
| 2003/0051304 | A1 * | 3/2003 | Chang | 15/209.1 |
| 2007/0022527 | A1 | 2/2007 | Russo et al. | |

FOREIGN PATENT DOCUMENTS

| | | | |
|---|---|---|---|
| JP | 03-086523 | A | 11/1991 |
| JP | 10-216003 | A | 8/1998 |
| WO | 95/27469 | A1 | 10/1995 |

* cited by examiner

*Primary Examiner* — Mark Spisich
(74) *Attorney, Agent, or Firm* — Browdy and Neimark, P.L.L.C.

(57) ABSTRACT

A bathing aid includes a base, a scrubbing member mounted to a top side of the base, a fastener mounted to a bottom side of the base for detachably fastening the base to a surface of an object, and a binding member for binding the scrubbing member and the fastener to the base. The base has a positioning portion and a connecting part. The scrubbing member is partially received in the positioning portion. The connecting part is detachably coupled with the base of another same bathing aid to substantially expand the scrubbing area for body cleaning. In this way, the bathing aid can not only be fixed to a wall or the ground for the user to conveniently clean his or her back or feet but expand the area for contact the user's body or serve as a pillow for the user to lie on.

10 Claims, 14 Drawing Sheets

BATHING AID AND BATHING ASSEMBLY USING THE SAME

CROSS-REFERENCE TO RELATED APPLICATIONS

The present invention is a continuation in part of U.S. patent application Ser. No. 12/892,878 field on Sep. 28, 2010 (now abandoned), the entire teachings of which are incorporated herein by this reference. U.S. patent application Ser. No. 12/892,878 is a continuation in part of U.S. patent application Ser. No. 12/034,188 (now abandoned).

BACKGROUND OF THE INVENTION

1. Field of the Invention

The present invention relates generally to a bathing appliance and more specifically, to a bathing aid for body cleaning, which can be fixed on a surface of an object for helping a user clean his back and/or feet conveniently, and a bathing assembly constructed by a plurality of the aforesaid bathing aids, which can be served as a back pad for a bath tub.

2. Description of the Related Art

When using a conventional bathing aid, such as a bathing ball or a sponge, a user has to hold it in his hand tightly for scrubbing his body. When the user uses the aforesaid conventional bathing aid to clean his foot, he will have to raise one leg and stand on a wet floor with the other leg. Under this circumstance, the user may have a foot slip or body fall, causing injury. Besides, it is also inconvenience for the user to clean his back by holding the conventional bathing ball or sponge with his hand.

Another conventional bathing aid constructed by fixing a bathing ball or a sponge on an elongated handle has been developed to enable the user to clean his back conveniently. However, when a user uses this kind of bathing aid to scrub his feet, the user still needs to raise his leg for cleaning purpose. As a result, this kind of bathing aid may be inconvenient and not safety for elder people, children, and/or handicap people to use.

U.S. Pat. No. 5,175,896 disclosed a bathroom accessory including a base member, suction cups on one face of the base member and a plurality of projections projecting from the base member. Although the bathroom accessory can be detachably fixed on a wall for helping a user to clean his back, it cannot provide an appropriate scrubbing area for body cleaning to meet a user's actual need due to its fixed size. Besides, those projections deteriorate the comfort of the bathroom accessory. A modular system for stimulation and exfoliation of human skin disclosed in U.S. Pat. No. 7,500,282 includes a unitary body which can be detachably interconnected with an additional unitary body to enlarge the scrubbing area for body cleaning. However, the aforesaid modular system also includes a multiplicity of spaced projections for scrubbing, resulting in deterioration of comfort of the modular system. In addition, this patent though taught that the base includes the central mounting recess for detachably receiving the suction cup, but the suction cup only has its front end portion received in the mounting recess, so the base and the suction cup are subject to separation from each other to result in a user's inconvenience. Furthermore, U.S. Pat. No. 6,343,774 disclosed a body washer device including several washing members disposed on an elongate member. Because the elongate member is spaced from the wall when it is positioned upon a shower wall, the supporting strength of the body washer device may be insufficient. Besides, the washing members may move when being used to scrub a user's body due to it cannot be stably disposed on the elongate member.

SUMMARY OF THE INVENTION

The present invention is accomplished in view of the above-noted circumstances. The primary objective of the present invention is to provide a bathing aid, which can be detachably fixed on a wall or a floor of a bathing room for enabling a user to conveniently clean his or her back and/or feet by simply moving his back and/or foot to avoid the danger resulting from standing up with one foot.

It is another objective of the present invention to provide a bathing aid, which can be detachably connected with one or more same bathing aids, such that a bathing assembly comprising a plurality of the aforesaid bathing aids coupled together can be constructed having a large scrubbing area for body cleaning or serving as a pillow or a back pad for a bath tub.

In order to achieve the aforesaid objectives, the bathing aid of the present invention comprises a base, a scrubbing member, a fastener, and a binding member. The base includes a top side, a bottom side, a positioning portion, and a connecting part. The scrubbing member is mounted to the top side of the base and partially received in the positioning portion. The connecting part is detachably coupled with the base of another same bathing aid, so the scrubbing area for body cleaning can become substantially larger. The fastener is mounted to the bottom side of the base for fastening the base to a surface of an object detachably. The binding member can bind the scrubbing member and the fastener to the base.

In a preferred embodiment of the present invention, the positioning portion includes a convexity and a plurality of protuberances. The convexity is located at a center part of the base. The protuberances protrude toward the scrubbing member from the top side of the base and are arranged around the center part of the base.

Preferably, the convexity includes a positioning hole and two through holes. The positioning hole is located on a center of the bottom side of the base. Each of the through holes is located on the top side of the base and communicates with the positioning hole. The fastener includes a front end portion and a rear end portion. The front end portion is inserted into the positioning hole and includes a via hole communicating with each of the through holes for a binding member to pass through for the binding purpose.

Preferably, each of the protuberances includes a plurality of positioning ribs and the positioning ribs are radially arranged around the center part of the base.

Preferably, each of the positioning ribs includes a toothed portion formed on a top side thereof.

Preferably, the positioning ribs are increasingly high from the center part of the base toward an external edge of the base.

Preferably, the scrubbing member is formed of a tubular mesh.

Preferably, the connecting part includes at least one through hole formed on the base and at least one convex post corresponding to the at least one through hole.

Preferably, the at least one convex post is formed of a body portion and a head portion. The body portion is inserted into the at least one through hole. The head portion is stopped against the bottom side of the base.

The at least one through hole and the at least one convex post are arranged alternately in an equal interval and adjacent to the external edge of the base.

In light of the above, the bathing aid of the present invention is structurally firm and detachably fixed to a surface of an object, such as a wall or the ground, so the user only needs to simply move his or her body and then his or her back or feet can be easily cleaned. In addition, the bathing aid of the present invention can be detachably combined with another same bathing aid, so the user can expand or diminish the scrubbing area for body cleaning. Furthermore, the present invention with the larger scrubbing area can server as a pillow for the user to lie on while the user is taking bath.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
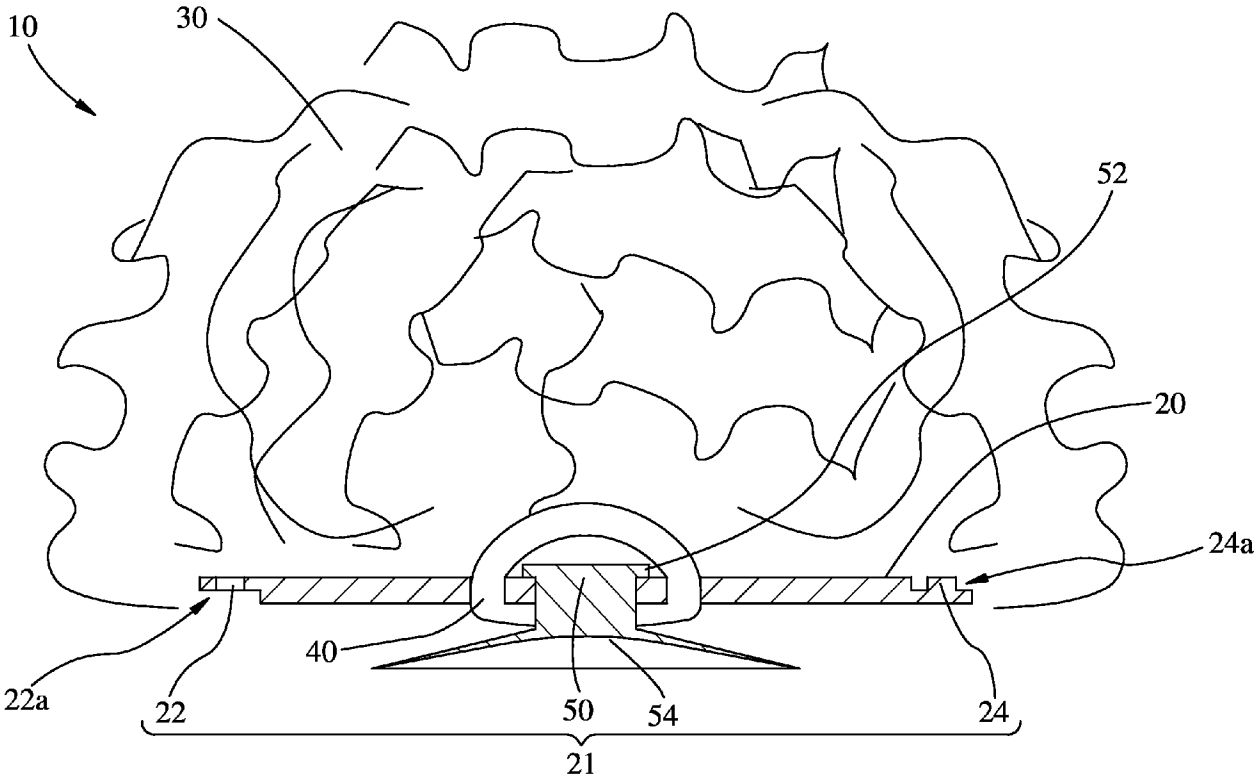
FIG. 1 is a sectional view of a bathing aid according to a first preferred embodiment of the present invention.
Figure 2:
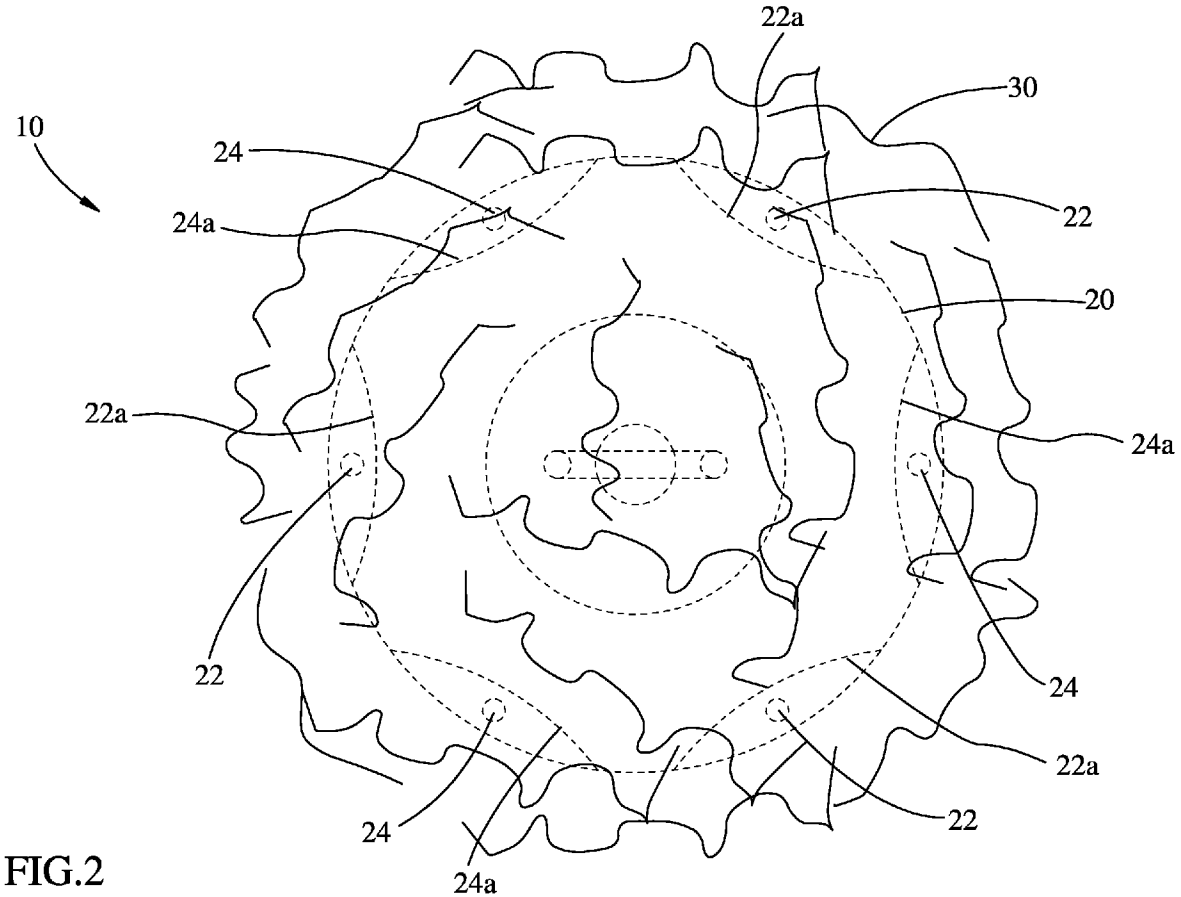
FIG. 2 is a top view of the bathing aid according to the first preferred embodiment of the present invention.
Figure 3:
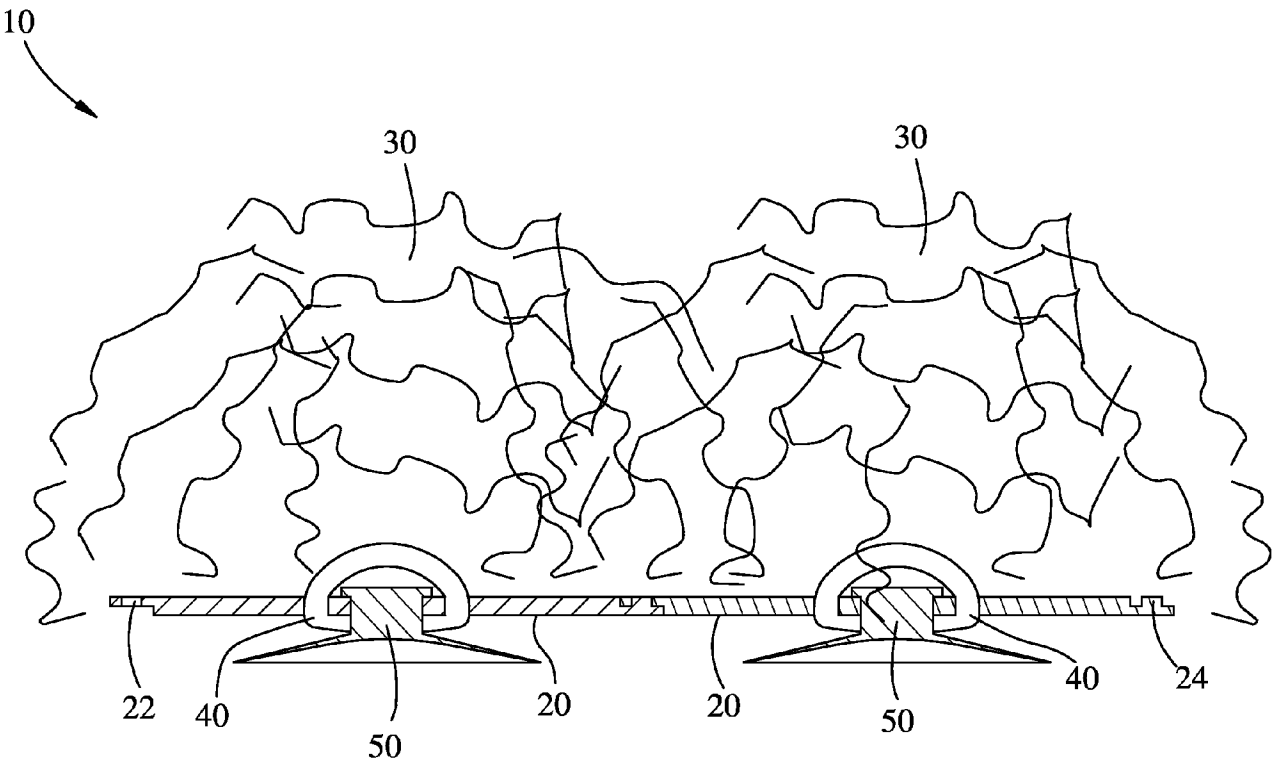
FIG. 3 is a schematic drawing, showing that two of the bathing aids constructed according to the first preferred embodiment are coupled with each other.

As shown in FIGS. 1 to 3, a bathing aid 10 in accordance with a first preferred embodiment of the present invention comprises a base 20, a scrubbing member 30 fastened to the base 20, and a fastener 50 disposed at the base 20.

In this embodiment, the shape of the base 20 is circle. It is however to be appreciated, the shape of the base 20 may be triangle, rectangle or polygon. The base 20 includes a connecting part 21 which has, but not limited to, three holes 22 disposed equidistantly thereon, and three pins 24 disposed equidistantly thereon and each arranged between two of the holes 22. As will be appreciated, the number of the holes 22 and the pins 24 can be more than or less than three in actual practice. Further, the holes 22 and the pins 24 are alternately arranged adjacent to the periphery of the base 20. As shown in FIGS. 1 and 2, the bottom surface of the base 20 is provided with three meniscus-shaped bottom recesses 22*a* and each of the holes 22 penetrates a center part of one of the bottom recesses 22*a*. The top surface of the base 20 is also provided with three meniscus-shaped top recesses 24*a* and each of the pins 24 protrudes upwardly from a center part of one of the top recesses 24*a*. The pins 24 are configured in size and shape to be comparable with the holes 22, such that one pin 24 of the base 20 of one bathing aids 10 can be detachably inserted into one hole 22 of the base 20 of another same bathing aid 10, as shown in FIG. 3, to construct a bathing assembly comprising a plurality of the bathing aids 10.

The scrubbing member 30 is, but not limited to, a bathing ball in this embodiment. That is, the scrubbing member 30 can be a sponge, a loofah or any member can be used to clean body. The scrubbing member 30 is tied on the base 20 by using a rope 40 running through two holes of the base 20. As will be appreciated, the scrubbing member 30 can be fastened to the base 20 through another method, such as adhesion.

The fastener 50 is a suction cup having an elastic coupling stem 52 and a cup portion 54 in this embodiment. The elastic coupling stem 52 of the suction cup passes through and is secured to a center hole of the base 20, so that the cup portion 54 is located beneath the bottom surface of the base 20. Thus, the base 20 is capable of detachably fixing on a surface of an object through the cup portion 54 of the fastener 50.

As stated above, a bathing aid 10 according to the present invention can be detachably fixed on a surface such as a wall or a floor through the fastener 50, and correspondingly, the scrubbing member 30 can be fixed on the wall or the floor for enabling a user to clean his back and/or feet conveniently. Further, two or more bathing aids 10 can be combined together by means of the coupling of the pins to holes to form a bathing assembly having a large scrubbing area for body cleaning and/or for being used as a pillow or a back pad for a bath tub.

Figure 4:
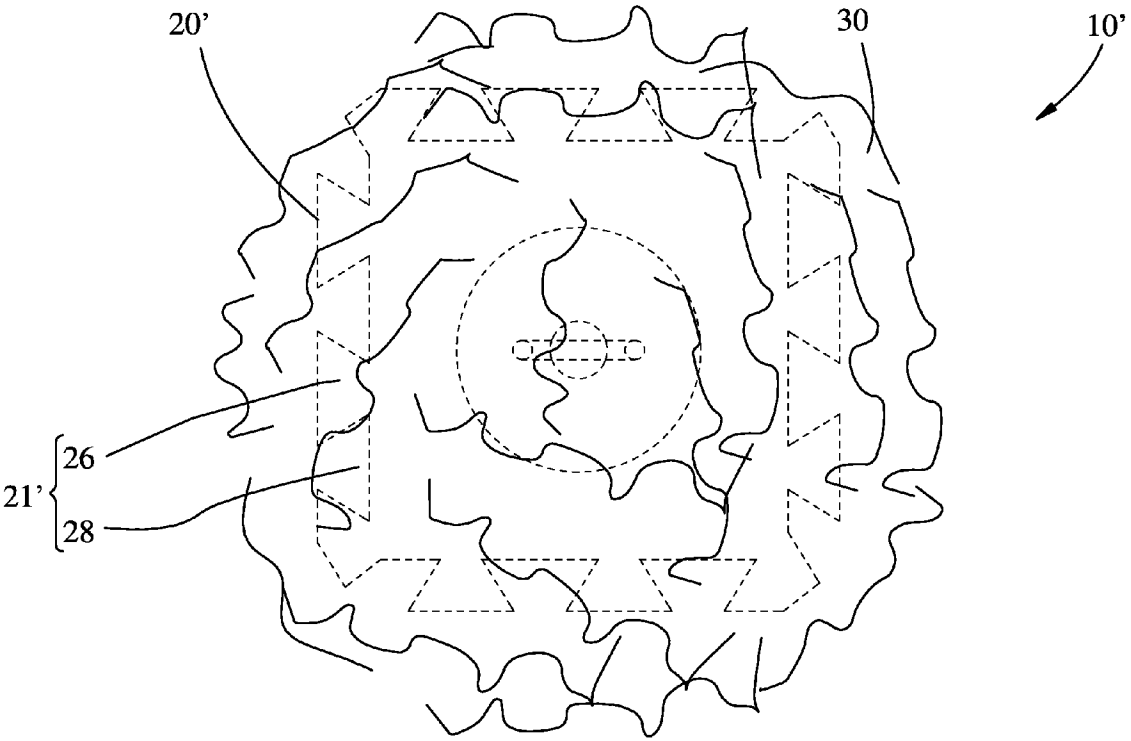
FIG. 4 is a top view of a bathing aid according to a second preferred embodiment of the present invention.
Figure 5:
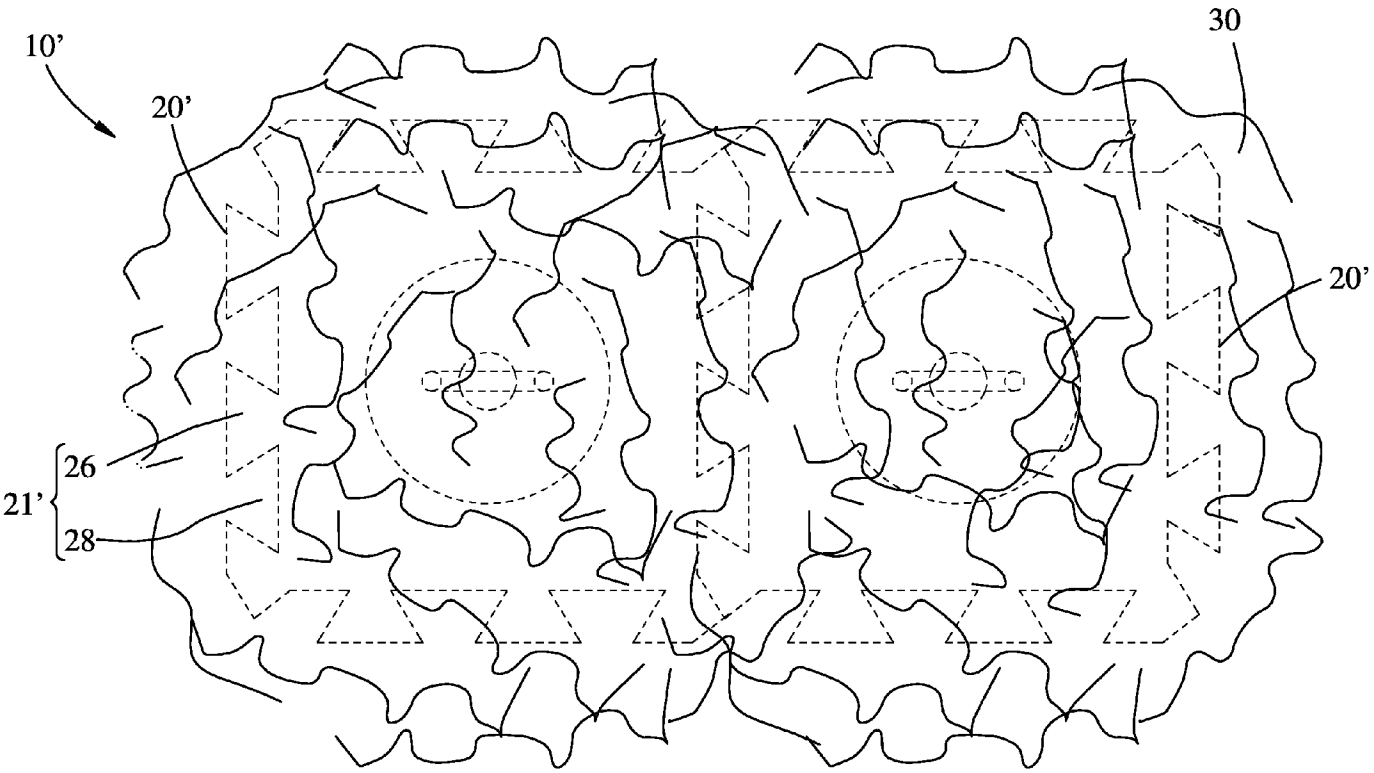
FIG. 5 is a schematic drawing, showing that two of the bathing aids constructed according to the second preferred embodiment are coupled with each other.

FIGS. 4 and 5 show a bathing aid 10' according to a second preferred embodiment of the present invention. The main difference between this embodiment and the first preferred embodiment is in that the shape of the base 20' is rectangle and the connecting part 21' thereof includes a plurality of protrusions 26 and a plurality of recesses 28, which are alternatively arranged around the periphery of the base 20'. The recesses 28 are configured in size and shape to be comparable with the protrusions 26, such that the recesses 28 at a side of the base 20' of one bathing aid 10' can be coupled with the protrusions 26 at a side of the base 20' of another bathing aid 10', as shown in FIG. 5, thereby realizing a bathing assembly comprising a plurality of bathing aids 10' with a large scrubbing area for body cleaning.

Figure 6:
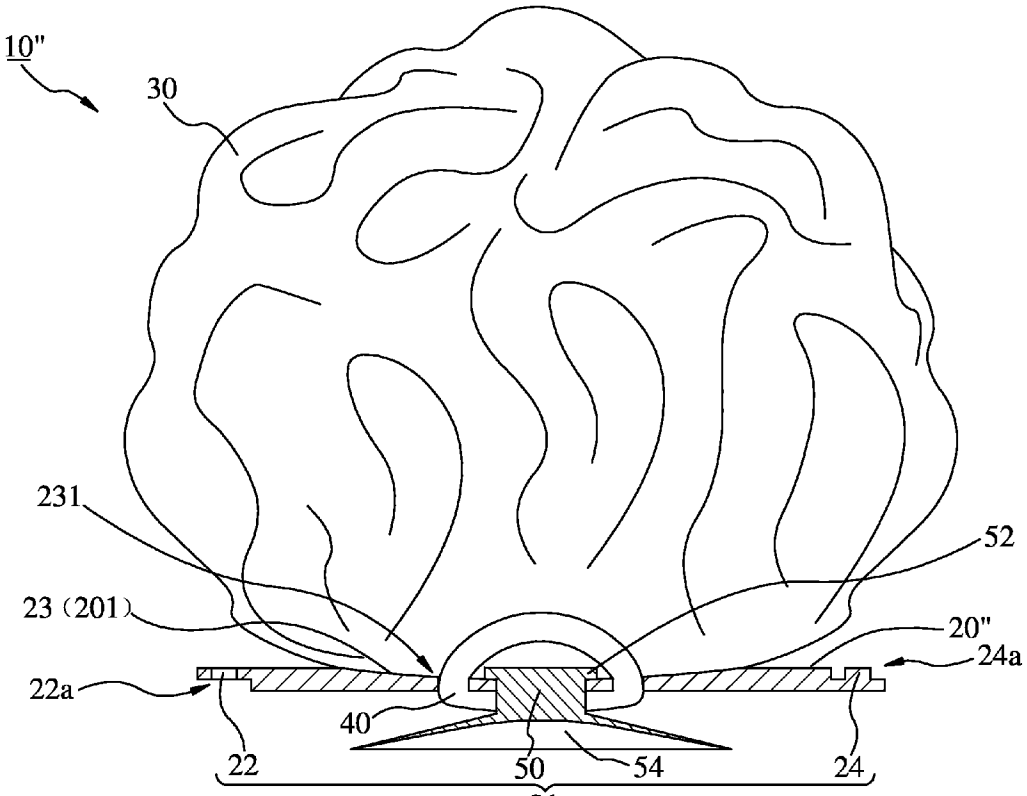
FIG. 6 is a sectional view of a bathing aid according to a third preferred embodiment of the present invention, showing a positioning part of the base is recessed.

FIG. 6 shows a bathing aid 10" according to a third preferred embodiment of the present invention. The main difference between this embodiment and the first preferred embodiment is in that the center part of the top surface of the base 20" is provided with a positioning part 23 which is a recess 201 and has an accommodating space 231. Besides, in this embodiment, the scrubbing member 30 is a bathing ball made of a tubular net through, but not limited to, the methods disclosed in U.S. Pat. Nos. 6,623,085, 5,709,434, and 5,758,386. Parts of the scrubbing member 30 is accommodated in the accommodating space 231 of the positioning part 23 of the base 20", and is tied on the base 20" by using a rope 40 running through two holes of the base 20", such that the scrubbing member 30 can be more stably positioned on the base 20".

Figure 7:
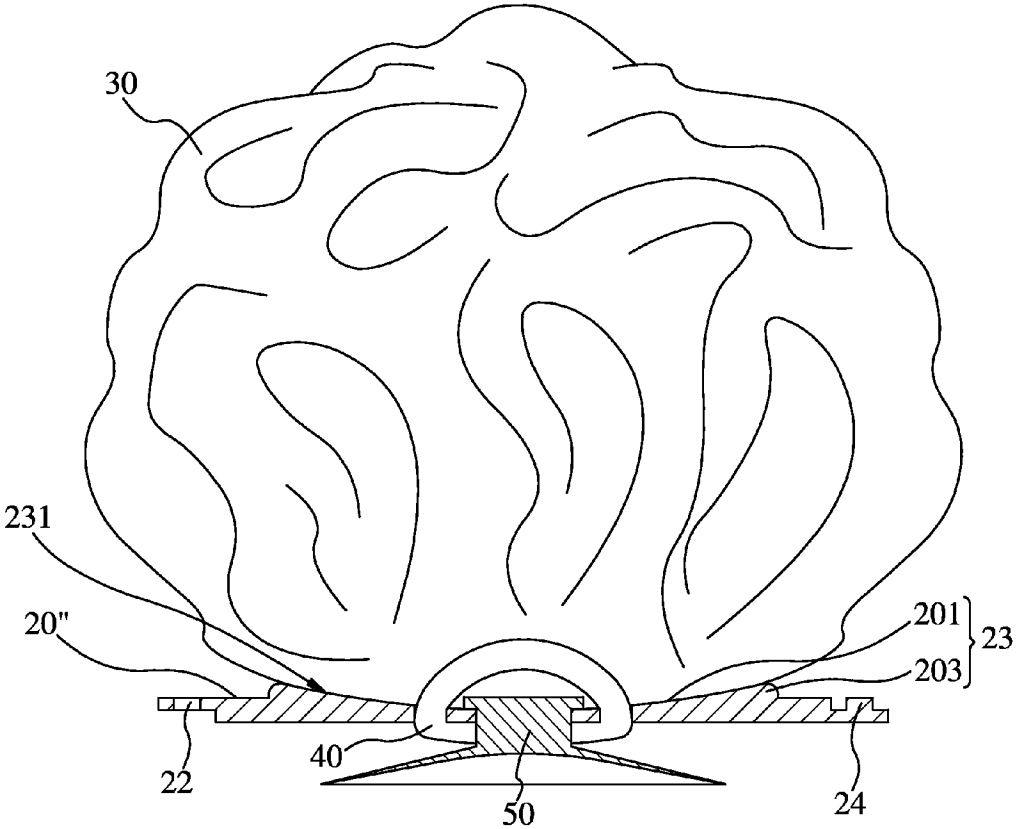
FIG. 7 is similar to FIG. 6, showing an alternate form of the positioning part of the base.
Figure 8:
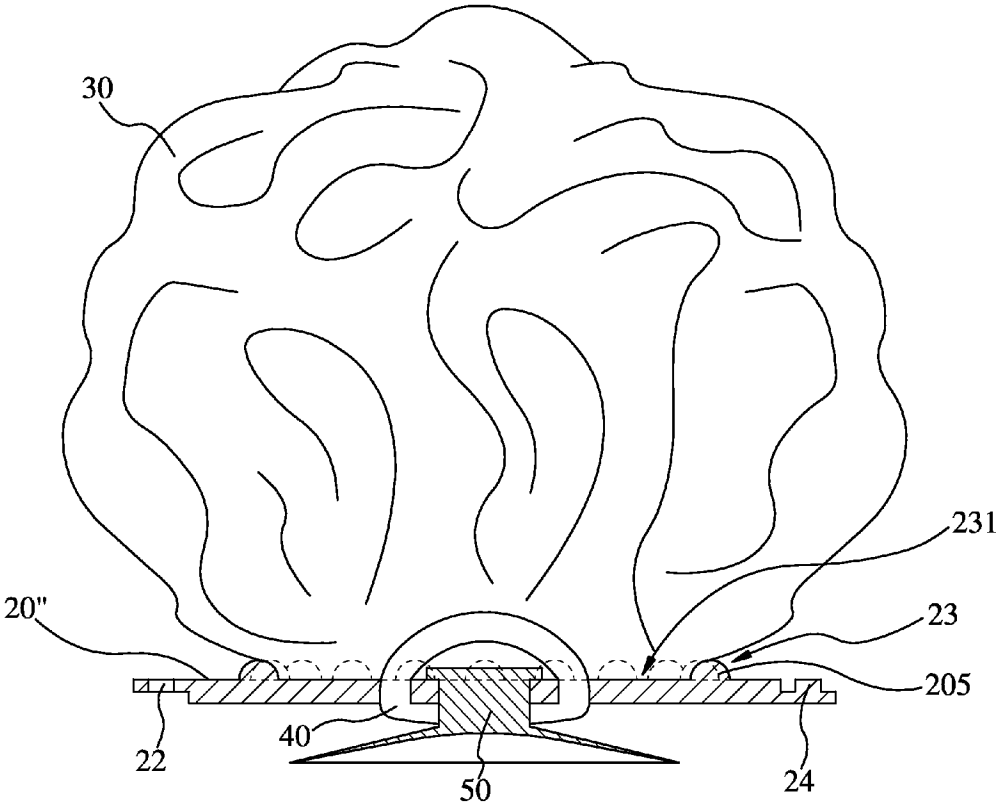
FIG. 8 is similar to FIG. 6, showing another alternate form of the positioning part of the base.
Figure 9:
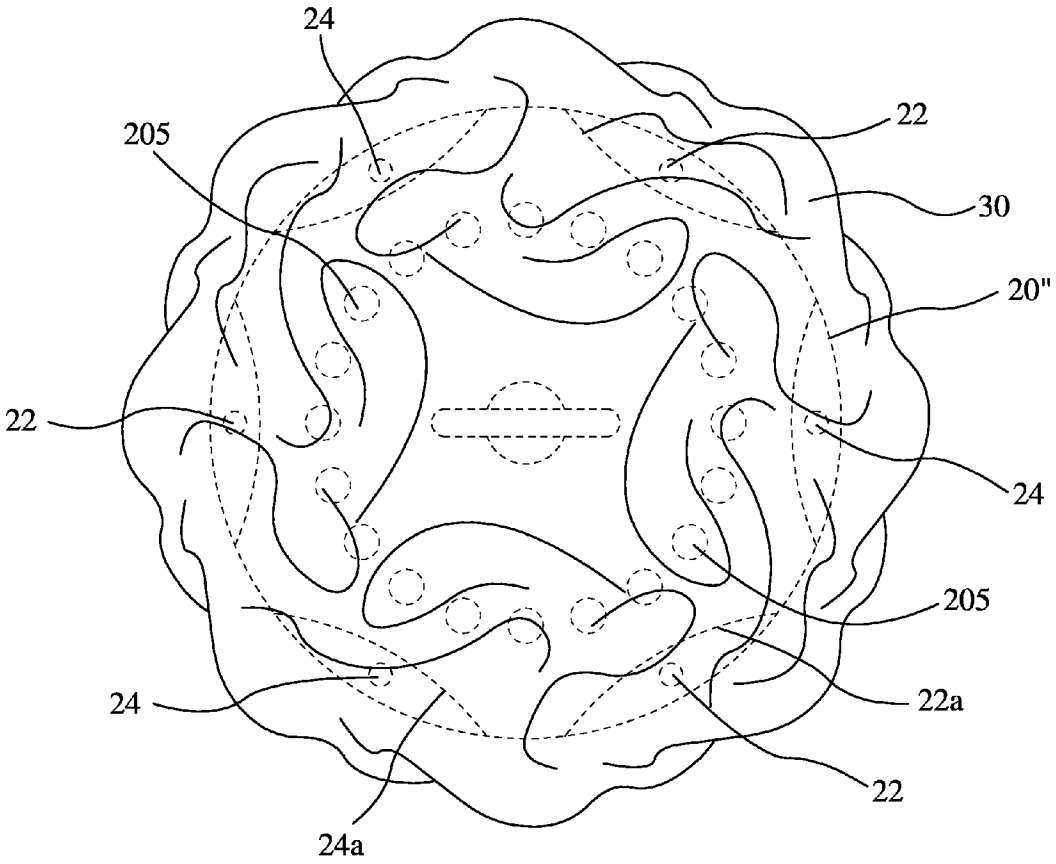
FIG. 9 is a top view of FIG. 8.

It will be appreciated that the positioning part 23 having the accommodating space 231 can have a plurality of alternate forms. For example, as shown in FIG. 7, the positioning part 23 is provided with a recess 201 and a protrusion 203 protruding outwardly and annularly along the periphery of the recess 201. Alternatively, as shown in FIGS. 8 and 9, the positioning part 23 is provided with a plurality of protuberances 205 protruding outwardly from the top surface of the base 20" and spacedly arranged around the center part of the base 20", such that an accommodating space 231 is defined by the top surface of the base 20" and the area surrounded by the protuberances 205 for accommodating a part of the scrubbing member 30. In this way, the scrubbing member 30 can be secured on the base 20" more stably. Furthermore, the protuberances 205 can give a massage for the user's body.

Figure 10:
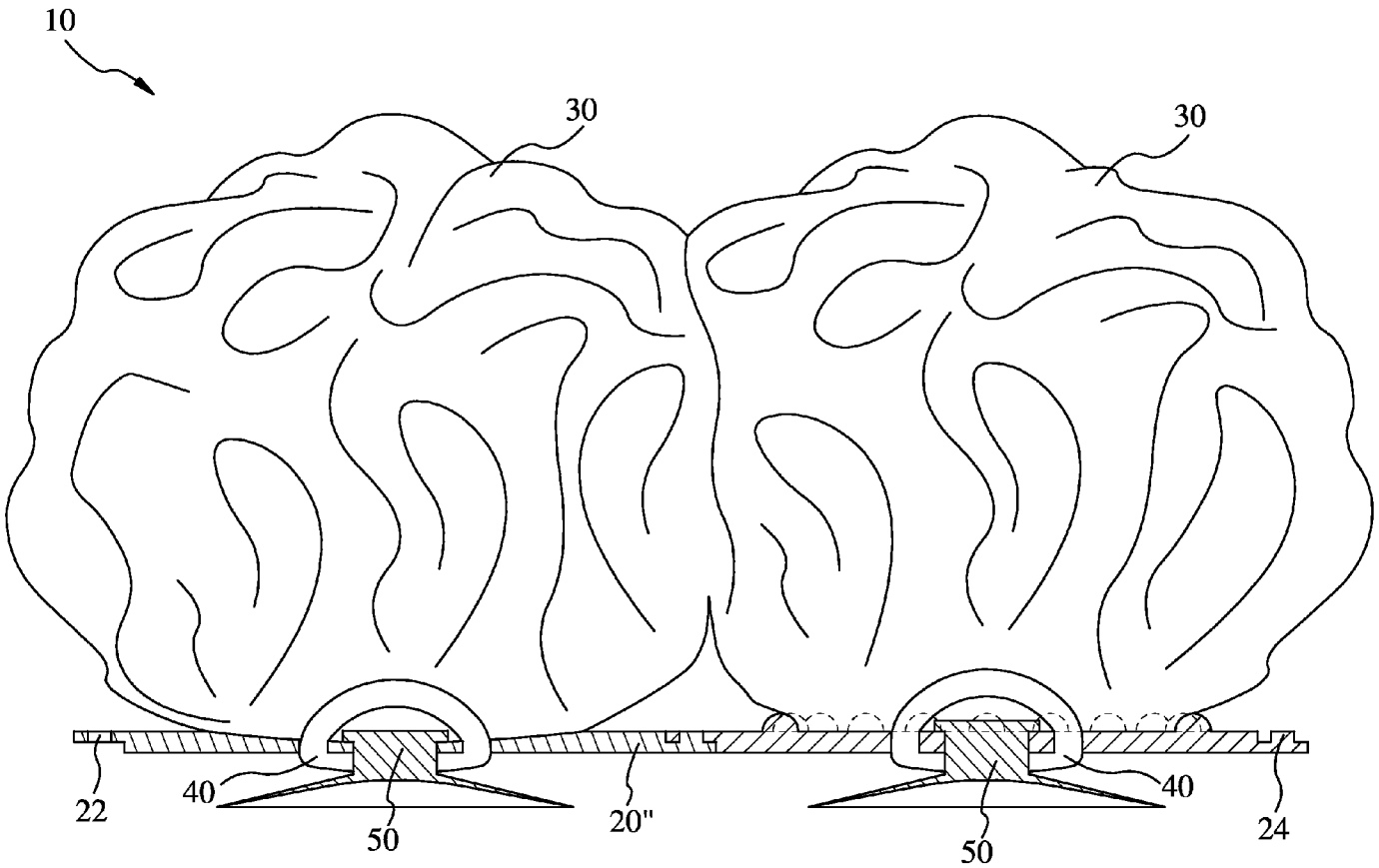
FIG. 10 is a schematic drawing, showing that two of the bathing aids constructed according to the third preferred embodiment are coupled with each other.

As shown in FIG. 10, two or more bathing aids 10" can be combined together by means of the coupling of the pins 24 to holes 22 to form a bathing assembly having a large scrubbing area for body cleaning and/or for being used as a pillow or a back pad for a bath tub.

As stated above, by means of the connecting part provided at the base of the bathing aid, two or more bathing aids of the present invention can be combined together to form a bathing assembly having a large scrubbing area. It is however to be appreciated that the configuration of the connecting part is not limited to the examples disclosed in the above-mentioned embodiments. For example, the connecting part of the base of the bathing aid of the present invention can be provided with a hook and loop fastener for connection purpose.

Figure 11:
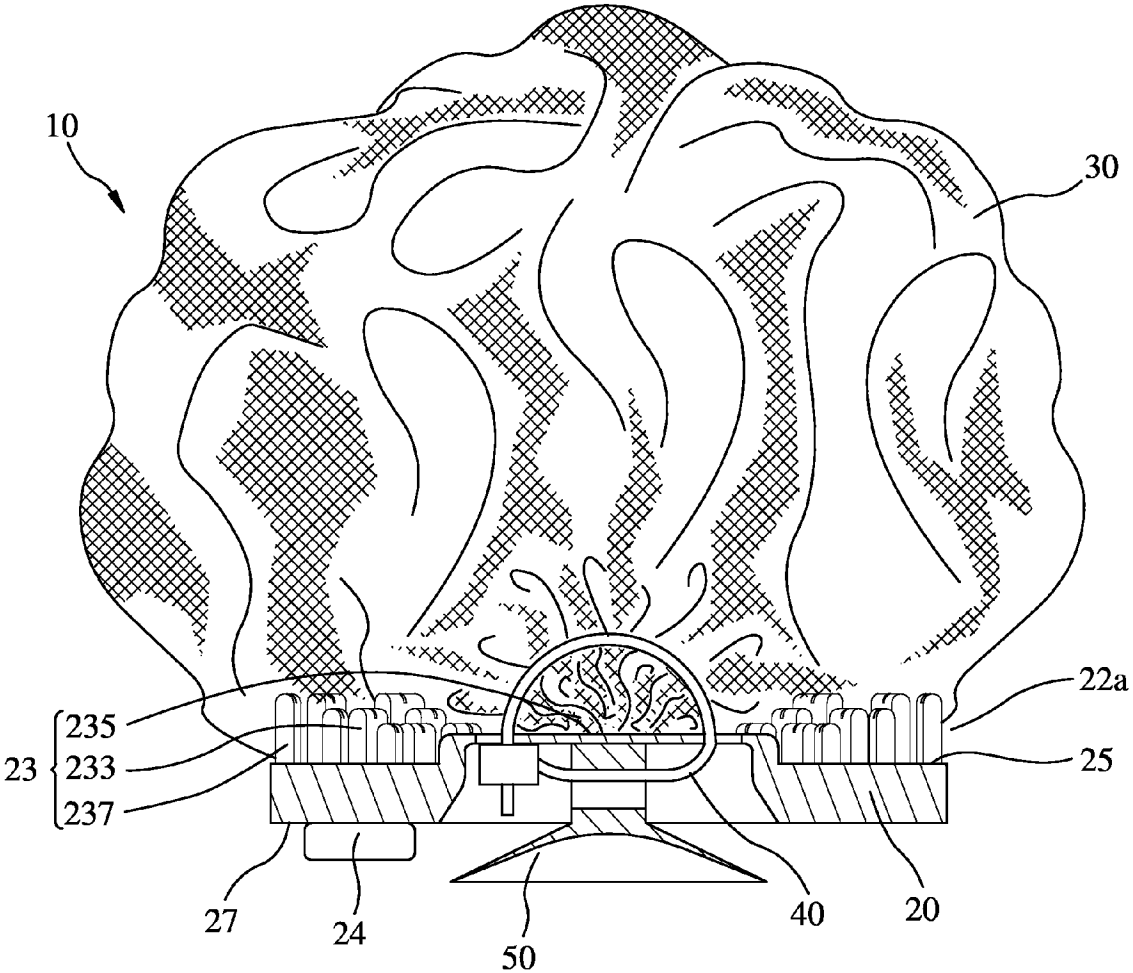
FIG. 11 is a sectional view of a bathing aid constructed according to a fourth preferred embodiment.
Figure 12:
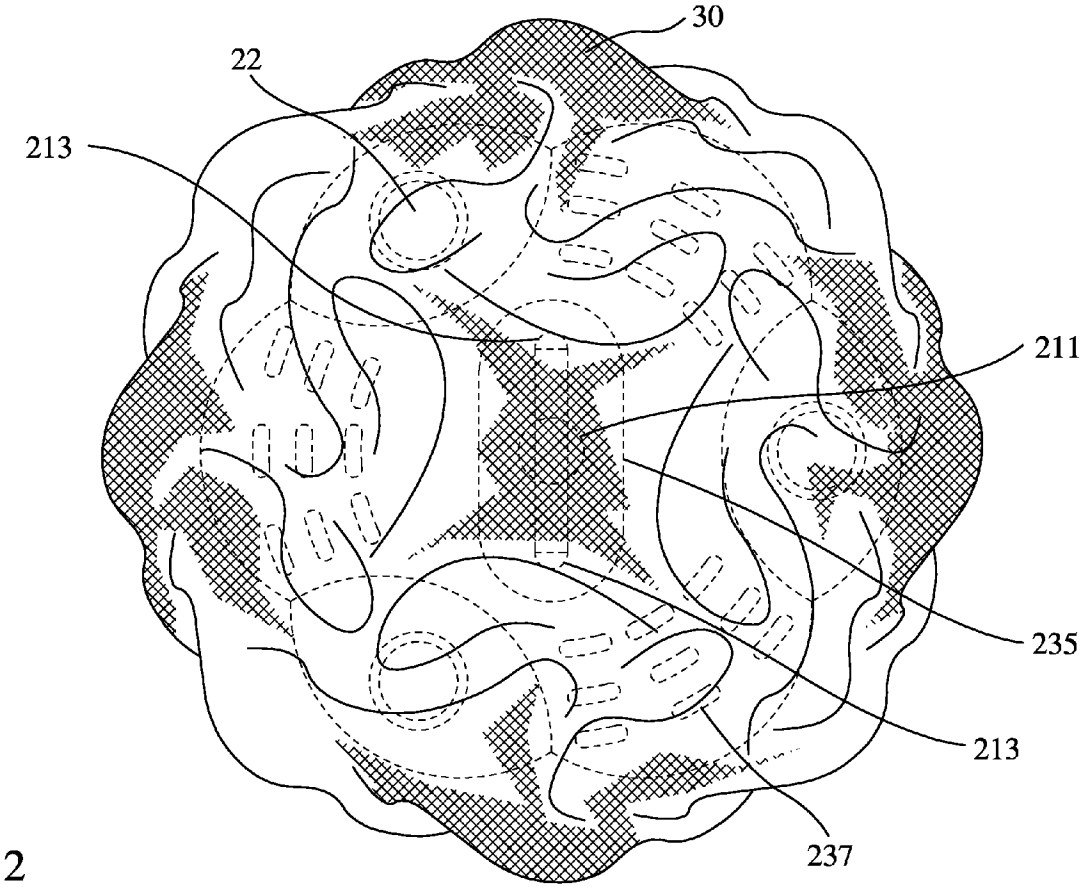
FIG. 12 is a top view of FIG. 11.
Figure 13:
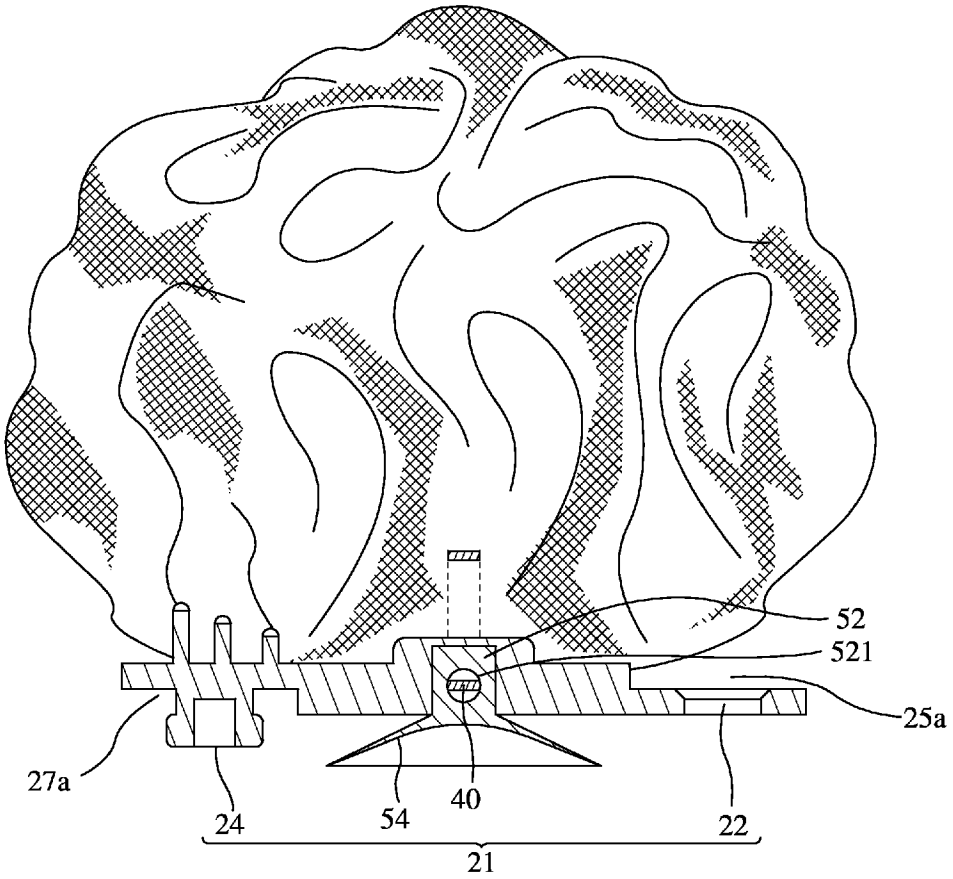
FIG. 13 another sectional view of the bathing aid constructed according to the fourth preferred embodiment.

Referring to FIGS. 11-13, a bathing aid 10 constructed according to a fourth preferred embodiment is formed of a base 20, a scrubbing member 30, a binding member 40, and a fastener 50. The base 20 can be made of a resilient material and includes a top side 25, a bottom side 27, a positioning portion 23, and a connecting part 21. The scrubbing member 30 is formed of a tubular mesh and mounted to the top side 25 of the base 20 and partially received in the positioning portion 23. The connecting part 21 is detachably coupled with the base 20 of another same bathing aid 10, so the scrubbing area for body cleaning can become substantially larger. The fastener 50 is mounted to the bottom side 27 of the base 20 for detachably fastening the base 20 to a surface of an object. The binding member 40-30 can bind the scrubbing member 40 and the fastener 50 to the base 20.

It is to be noted that the positioning portion 23 includes a plurality of protuberances 233 and a convexity 235. The protuberances 233 each protrude toward the scrubbing member 30 from the top side 25 of the base 20 and are arranged around the center part of the base 20. Each of the protuberances 233 includes a plurality of positioning ribs 237. The positioning rubs 237 each are provided with a toothed portion on a top side thereof and arranged radially from a center part of the base 20 toward an external edge of the base 20. The positioning ribs 237 are increasingly high from the center part of the base 20 toward the external edge of the base 20. The positioning ribs 237 can not only support the scrubbing member 30 firmly by means of its arc-shaped formation but have the toothed portions engaged with the scrubbing member 30 for enhanced skidproof effect. Furthermore, each of the positioning ribs 237 is made of a resilient material, so the positioning ribs 237 can give a massage for the user's body. The convexity 235 is located at the center part of the base 20 and provided with a positioning hole 211 and two through holes 213. The positioning hole 211 is located on a center of the bottom side 27 of the base 20. Each of the through holes 213 is located on the top side 25 of the base 20 and communicates with the positioning hole 211. The fastener 50 includes a front end portion 52 and a rear end portion 54. The front end portion 52 is inserted into the positioning hole 211 and is provided with a via hole 521 communicating with the through holes 213 for the binding member 40 to pass through for the binding purpose. The rear end portion 54 is a suction cup in this embodiment. The binding member 40 is a zoster in this embodiment and passes through one of the through holes 213 and then moves to the positioning hole 211 along the through hole 213; meanwhile, the binding member 40 passes through the via hole 521 and the other through hole 213 and then passes by the center of the scrubbing member 30; finally, two ends of the binding member 40 are tied together. In this way, the scrubbing member 30 and the fastener 50 are confined by the binding member 40 to be firmly mounted to the top side 25 and the bottom 27 of the base 20, respectively. In addition, no matter whether the bathing aid is being used or has been used, the fastener 50 is not subject disengagement from the positioning hole 211 while an external force is applied to the base 20 vertically or horizontally, so it is favorable to the operational convenience and safety of the present invention.

Figure 14:
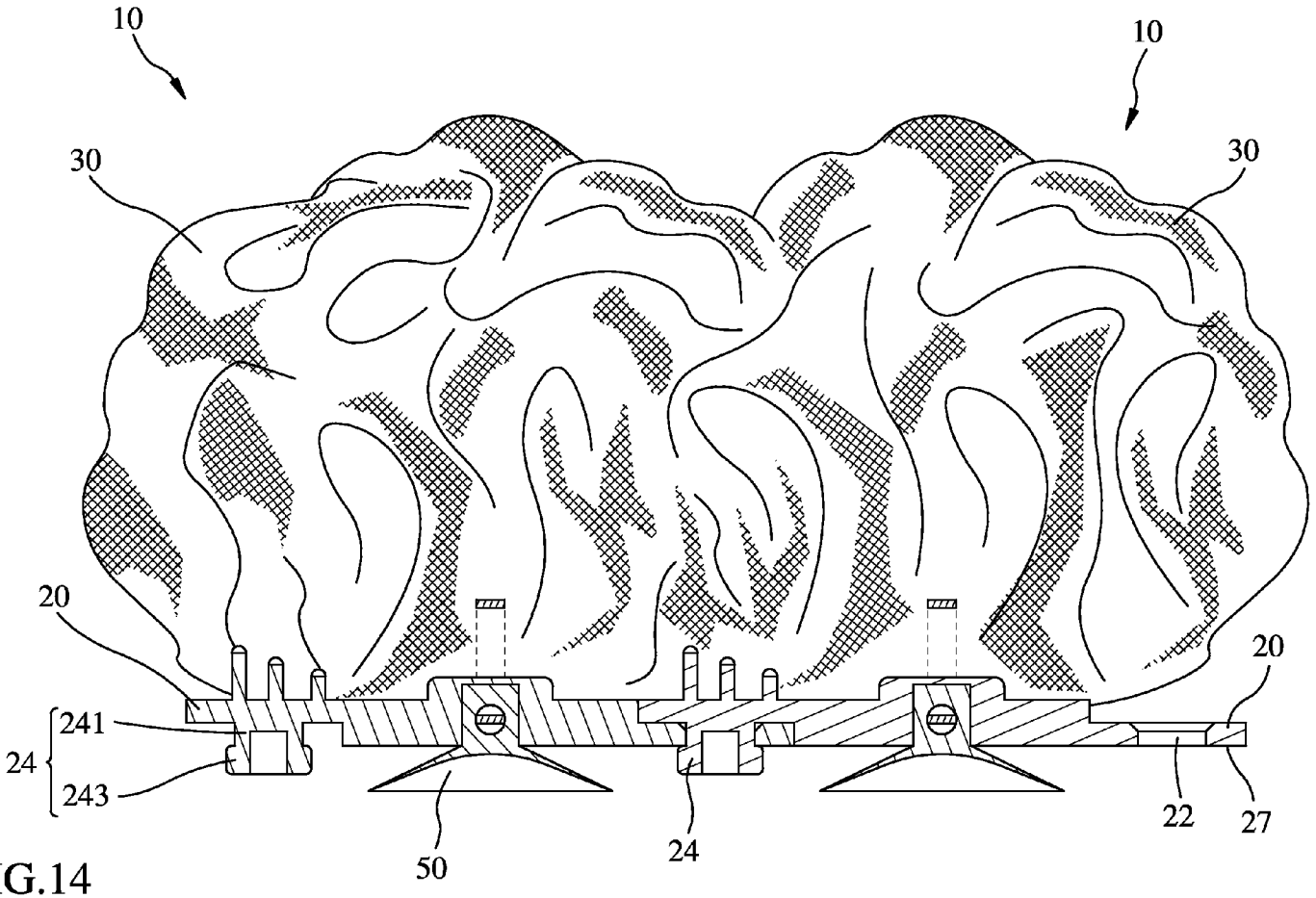
FIG. 14 is a schematic view, showing that two of the bathing aids constructed according to the fourth preferred embodiment are coupled with each other.

Referring to FIGS. 13 and 14, to enable the user to combine the bathing aids 10 conveniently and firmly to expand the area for contact with the user's body or to serve as a pillow for the user to lie on, so the connecting part 21 is designed to have at least one through hole 22 and at least one convex post 24 corresponding to the at least one through hole 22. The through hole 22 and the convex post 24 are alternately arranged in an equal interval and adjacent to the external edge of the base 20. The base 20 further includes three meniscus-shaped top recesses 25*a* formed on the top side 25 and three meniscus-shaped bottom recesses 27*a* formed on the bottom side 27. The through hole 22 runs through a center of one of the top recesses 25*a* and the convex post 24 protrudes upward from a center of one of the bottom recesses 27*a*. The top recesses 25*a* can match the bottom recesses 27*a*. The convex post 24 includes a body portion 241 and a head portion 243 wherein the body portion 241 is inserted into the through hole 22 and the head portion 243 is stopped against the bottom side 27 of the base 20. The head potion 243 though has a larger external diameter than that of the through hole 22, but each of the through hole 22 and the convex post 24 is made of a resilient material, so in assembly, the user only needs to slightly apply a force to make the convex post 24 squeezed into and pass through the through hole 22 and in this way, the assembly is convenient and preferably firm. Moreover, the head portion 243 is approximately as high as the fastener 50. Thus, when the use applies a force to the bathing aid 10, the convex post 24 can abut against a surface of object to serve as an auxiliary support.

In conclusion, the bathing aid 10 of the present invention makes the arc-shaped structure of the positioning ribs 237 firmly support the scrubbing member 30, so the scrubbing member 30 can be firmly mounted on the base 20. In addition, the toothed portions of the positioning ribs 237 can be engaged with the scrubbing member 30 to enhance the skidproof effect and the positioning ribs 237 are made of the resilient material to give a massage for the user's body. The scrubbing member 30 and the fastener 50 are confined by the binding member 40 to be firmly mounted to the top side 25 and the bottom side 27 of the base 20, respectively, so no matter whether the bathing aid 10 is being use or has been used, the fastener 50 is not subject to disengagement from the positioning hole 211 due to an external force vertically or horizontally applied to the base 20 and in this way, it leads to the operational convenience and safety. Furthermore, the body portion 241 of the convex post 24 is inserted into the through hole 22 of another same bathing aid 10 and the head portion 243 abuts against the bottom side 27, so the assembly is convenient and the structure is firm. Because the head portion 243 of the convex post 24 is approximately as high as the fastener 50, when the user applies a force to the bathing aid 10, the convex post 24 can abut against a surface of an object to serve as an auxiliary support.

The invention being thus described, it will be obvious that the same may be varied in many ways. Such variations are not to be regarded as a departure from the spirit and scope of the invention, and all such modifications as would be obvious to one skilled in the art are intended to within the scope of the following claims.

What is claimed is:

1. A bathing aid comprising a base having a top side and a bottom side, a scrubbing member mounted to the top side of said base, and a fastener mounted to the bottom side of said base for detachably fastening the base on a surface of an object, the bathing aid being characterized in that:

said base comprises a positioning member and a connecting part, the scrubbing member being partially received in the positioning member, the connecting part being detachably coupled with the base of another same bathing aid to substantially expand scrubbing area for body cleaning; the bathing aid further comprises a binding member, which is able to bind the scrubbing member and the fastener onto the base.

2. The bathing aid according to claim 1, wherein the positioning member comprises a convexity and a plurality of protuberances, the convexity being located at a center part of the base, the protuberances protruding toward the scrubbing member from the top side of the base and being arranged around the center part of the base.

3. The bathing aid according to claim 2, wherein the convexity is provided with a positioning hole and two through holes, the positioning hole being located on a center of the bottom side of the base, each of the through holes being located on the top side of the base and communicating with the positioning hole; the fastener comprises a front end portion and a rear end portion, the front end portion being inserted into the positioning hole and having a via hole communicating with the through holes for the binding member to pass through for the binding purpose.

4. The bathing aid according to claim 3, wherein each of the protuberances comprises a plurality of positioning ribs and the positioning ribs are radially arranged from the center part of the base toward an external edge of the base.

5. The bathing aid according to claim 4, wherein each of the positioning ribs comprises a toothed portion formed at a top side thereof.

6. The bathing aid according to claim 5, wherein the positioning ribs are increasingly high from the center part of the base toward the external edge of the base.

7. The bathing aid according to claim 1, wherein the scrubbing member is formed of a tubular mesh.

8. The bathing aid according to claim 1, wherein the connecting part comprises at least one through hole formed on the base and at least one protrusive post corresponding to the at least one through hole.

9. The bathing aid according to claim 8, wherein the at least one protrusive post comprises a body portion and a head portion, the body portion being inserted into the at least one through hole, the head portion being stopped against the bottom side of the base.

10. The bathing aid according to claim 8, wherein the at least one through hole and the at least one protrusive post are alternately arranged in an equal interval and adjacent to an external edge of the base.

* * * * *